US005383810A

United States Patent [19]

Loving

[11] Patent Number: 5,383,810

[45] Date of Patent: Jan. 24, 1995

[54] REMOTE CONTROL FLYING MODEL SPACESHIP

[76] Inventor: Dann R. Loving, 4018 SW. 20th St., Gainesville, Fla. 32608

[21] Appl. No.: 33,363

[22] Filed: Mar. 18, 1993

[51] Int. Cl.[6] ..... A63H 27/00; A63H 30/04; B64C 15/00

[52] U.S. Cl. ..... 446/57; 446/60; 446/456; 244/12.2

[58] Field of Search ..... 446/57, 56, 58, 59, 446/60, 55, 34, 66, 211, 230, 231, 232, 33, 32, 31, 30, 456, 454; 244/12.2, 12.5, 12.4, 17.19; 60/232, 269

[56] References Cited

U.S. PATENT DOCUMENTS

| | | | |
|---|---|---|---|
| Re. 34,383 | 9/1993 | Rohring | 446/57 X |
| Des. 260,789 | 9/1981 | Probert . | |
| Des. 307,923 | 5/1990 | Probert . | |
| 3,360,218 | 12/1967 | Miller | 244/12.5 |
| 3,659,788 | 5/1972 | Oldfield et al. | 60/232 X |
| 4,044,972 | 8/1977 | Anker-Holth | 244/12.2 |
| 4,196,877 | 8/1980 | Mutrux | 244/12.2 |
| 4,250,658 | 2/1981 | Kress | 446/56 |
| 4,307,857 | 12/1981 | Godbersen | 446/56 X |
| 4,443,014 | 4/1984 | Kovit et al. | 446/57 X |
| 4,452,410 | 6/1984 | Everett | 244/12.2 |
| 5,199,643 | 4/1993 | Rozmus | 446/56 X |

FOREIGN PATENT DOCUMENTS

| | | | |
|---|---|---|---|
| 1168262 | 4/1964 | Germany | 60/232 |
| 2219560 | 12/1989 | United Kingdom | 244/12.2 |

OTHER PUBLICATIONS

Estes Catalog, Master Series #1275 "Starship Enterprise", p. 38, 1994.

*Primary Examiner*—Max Hindenburg
*Assistant Examiner*—D. Neal Muir
*Attorney, Agent, or Firm*—Edward M. Livingston

[57] ABSTRACT

A model spaceship having a tubular propulsion duct (1) with fan (25) to which a circular wing (2) is attached at a top-forward position and pod wings (3,4) positioned at each opposite top-side position. The circular wing (2) is supported by a forward strut (8) extended forwardly and upwardly from a top-front portion of the propulsion duct (1). Each pod wing (3,4) is supported by side struts (5,6) extended sidewardly and upwardly from an intermediate portion of the propulsion duct (1). The pod wings (3,4) are joined by a horizontal wing (7) that provides lift and horizontal stabilization. Contour of the circular wing (2), the pod wings (3,4), the side struts (5,6) and the horizontal wing (7) all provide lift. Lateral attitude control is provided by ailerons (15) on the pod wings (3,4). An elevator flap (18) for horizontal attitude control is positioned on an aft edge of the horizontal stabilizer wing (7). A model-airplane motor (24) provides rotation of the duct fan (25) for propulsion. Remote control of the ailerons (15), elevator (18) and motor (24) are provided by conventional remote controls (61) used for motorized model airplanes.

28 Claims, 5 Drawing Sheets

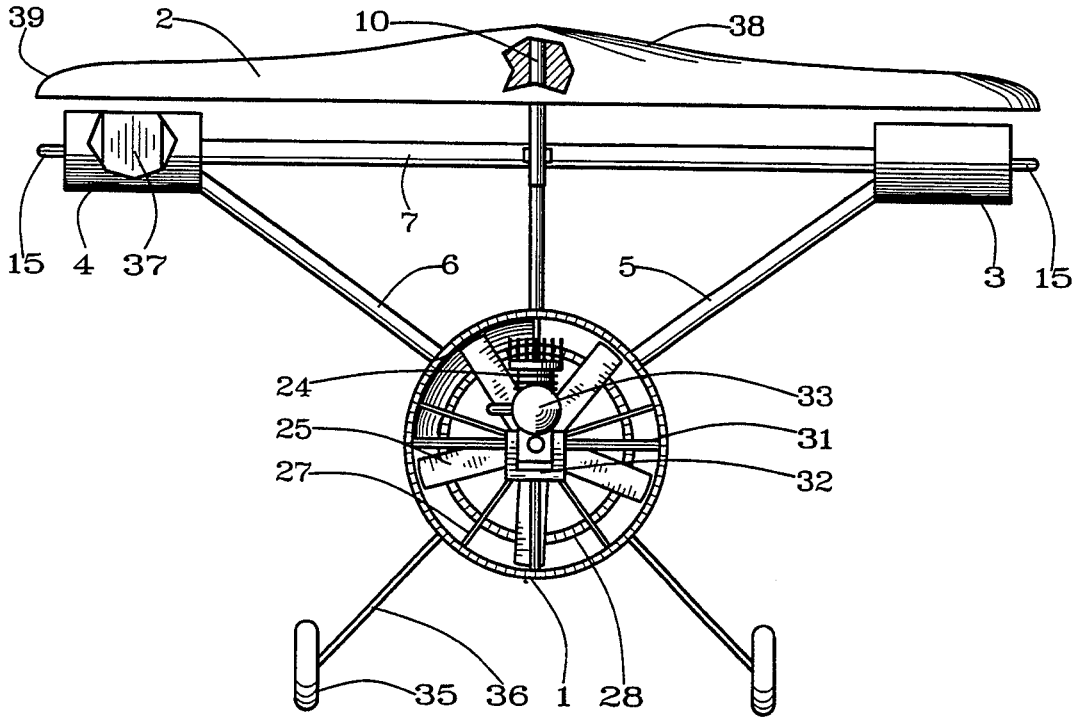
FIG.2
FIG.3
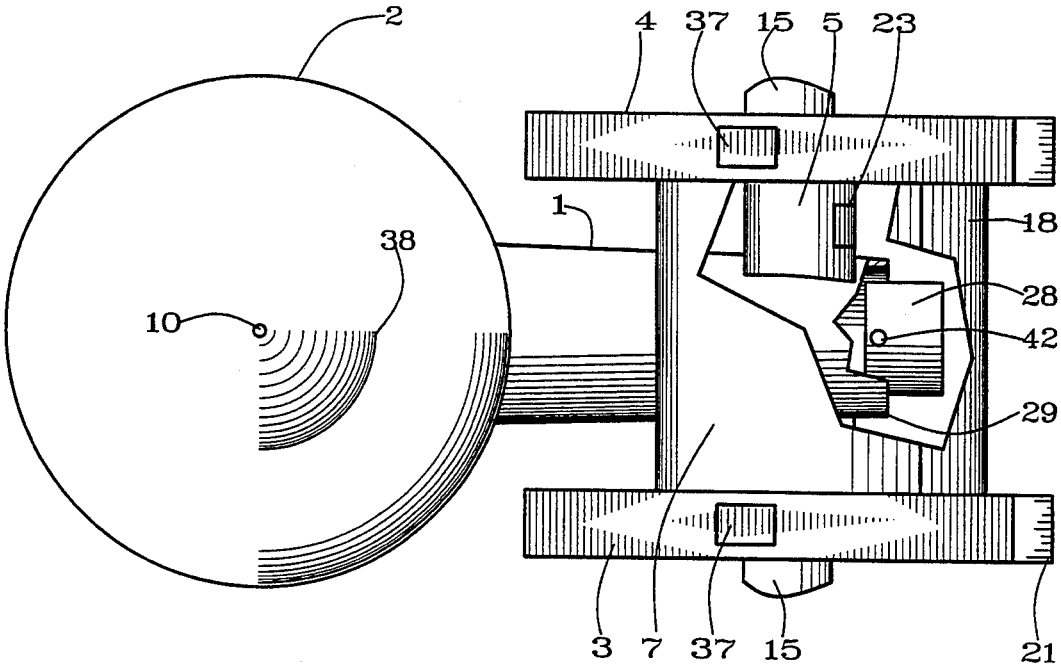

FIG.4
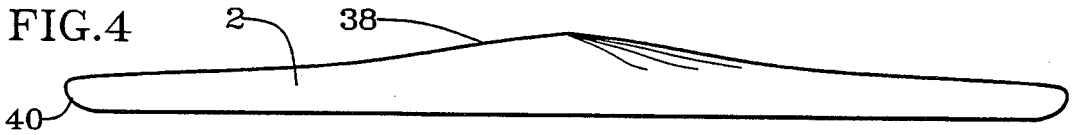
FIG.5
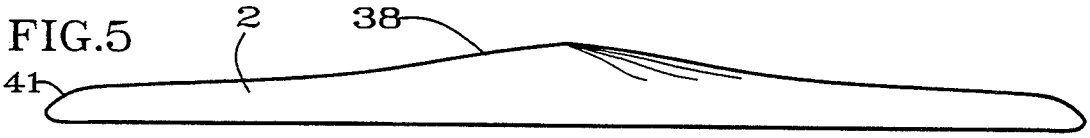
FIG.6
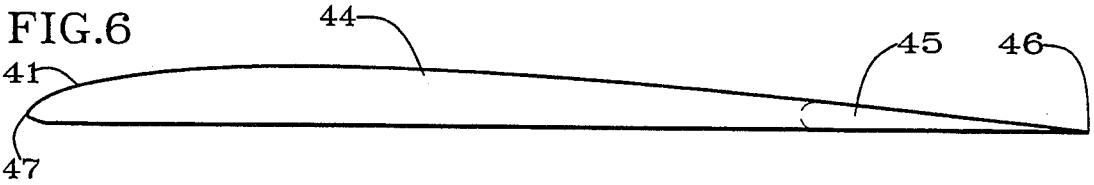
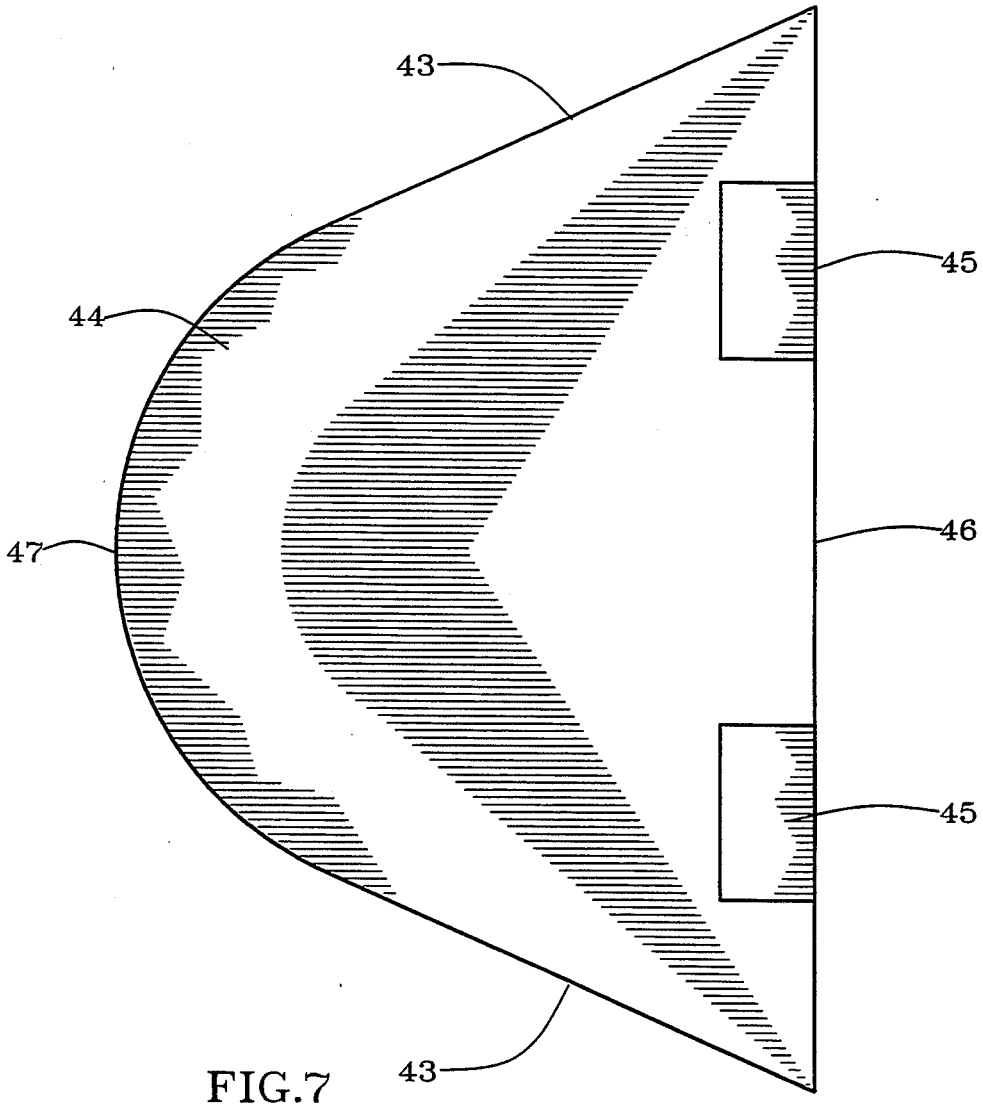
FIG.7

REMOTE CONTROL FLYING MODEL SPACESHIP

BACKGROUND OF THE INVENTION

This invention relates to remote-control model airplanes. More particularly, it relates to model airplanes structured to resemble the fictitious television Starship Enterprise® but with airfoil-lift structure for flying as a toy with remote control and for use as a vehicle for various full-sized human-portable and human-useable applications of some of its features and embodiments with and without remote control.

Previous structures and graphic representations of the famed fictitious Starship Enterprise® have not been designed for airfoil lift but for a fictional concept of space flight. Consequently, there are no known full-sized or toy vehicles resembling the now legendary Starship Enterprise® which are structured for flying in atmospheric conditions. A major objective of the designers of the Enterprise® appears to have been emphasis of differences between space and atmospheric flight conditions. Consequently, all known structural and artistic renditions of any spaceship bearing any resemblance to the mythical Starship Enterprise® are non-utilitarian or non-functional for achieving atmospheric flight.

A wide variety of model airplanes have been designed and produced to fly with remote control. Construction of model airplanes is so wide-spread and popular that it appears to be an outlet for creative drive. Yet no flying models of spaceships, rather than aircraft, are believed to have been designed or constructed in a manner taught by this invention.

U.S. Pat. No. Des. 260,789 and U.S. Pat. No. Des. 307,923, were both granted to A. G. Probert on Sep. 15, 1981 and on May 15, 1990 respectively for artistic design of the Starship Enterprise®. Both were titled TOY SPACESHIP. Both comprised generally a circular plate section, two side pods and one bottom pod. The latter design was more streamlined, making it more durably appealing or classic because of an impression it conveys of having a more functional shape. But neither had an airfoil-lifting form on any structural component. All forms that could have been altered into lifting surfaces were counterbalanced with negative lift forms. As a result neither of the two Probert designs would provide lift from forward propulsion in an atmosphere.

Popularization of both Probert designs for advertising returns, however, have created a demand potential for a model spacecraft or toy spaceship that fills a seemingly subconscious human compulsion for something that is so realistically different from the fictitious Starship Enterprise® that it can actually fly. It must fill a gap of public need for functional design created by its fictitious predecessor. It must be suggestive of the mythical model and yet so obviously different that its functional utility is readily apparent in order to merit wide public appeal.

Historically, in a similar manner to ways in which models have become realities of full-sized human-useable and human-portable machines and vehicles it is conceivable, foreseeable, anticipated and intended that features and embodiments of this invention are suitable for human transportation and use. It is not intended that this invention be limited to toys and models only.

SUMMARY OF THE INVENTION

One object of this invention, therefore, is to provide a model spaceship that can fly in the atmosphere.

Another object is to provide a model spaceship that resembles prior fictitious spaceships but which has differences of each component that provide airfoil lift.

Another object is to provide a model spaceship that has a working airfoil relationship of its major components.

Another object is to provide a model spaceship that has a relationship of flight control and attitude control of its structure and positioning of components.

Another object is to provide a model spaceship with obvious and apparent differences from prior fictitious spaceships.

Another object is to provide a model spaceship with motorized atmospheric propulsion.

Another object is to provide remote control for a model spaceship having motorized atmospheric propulsion.

Yet another object is to provide a propulsion-fan duct and thrust tube as a basic aerospace-vehicle component.

This invention accomplishes the above and other objectives with a remote-control model spaceship having a propulsion duct with tubular ducted fan to which a circular wing is attached at a top-forward position and having a pod wing positioned at each opposite top-side position. The circular wing is supported by a forward strut extended forwardly and upwardly from a top-front portion of the propulsion duct. Each pod wing is supported by a side strut extended sidewardly and upwardly from an intermediate portion of the ducted fan. The pod wings are joined by a horizontal wing that provides lift and horizontal stabilization. Contour of the circular wing, the pod wings, the side struts and the horizontal wing all provide lift. Lateral attitude control is provided by ailerons on the pod wings. An elevator flap for horizontal attitude control is positioned on an aft edge of the horizontal wing. A motor provides rotation of the ducted fan for propulsion. Remote control of the ailerons, elevator and motor are provided by conventional remote controls used for motorized model airplanes.

BRIEF DESCRIPTION OF THE DRAWINGS

This invention is described by appended claims in relation to description of a preferred embodiment with reference to the following drawings wherein:

FIG. 2 is a front view of the FIG. 1 illustration;

FIG. 3 is a cutaway top view of the FIG. 1 illustration;

FIG. 4 is a side view of a round-edged wing having a downward-slanting arcuate edge;

FIG. 5 is a side view of a round-edged wing having an upward-slanting arcuate edge;

FIG. 6 is a central cross sectional view of a round-edged wing having a delta extension at an aft edge, a conventional wing-lift structure and a front elevator flap;

FIG. 7 is a top view of the FIG. 6 illustration;

DESCRIPTION OF THE PREFERRED EMBODIMENT

Figure 1:
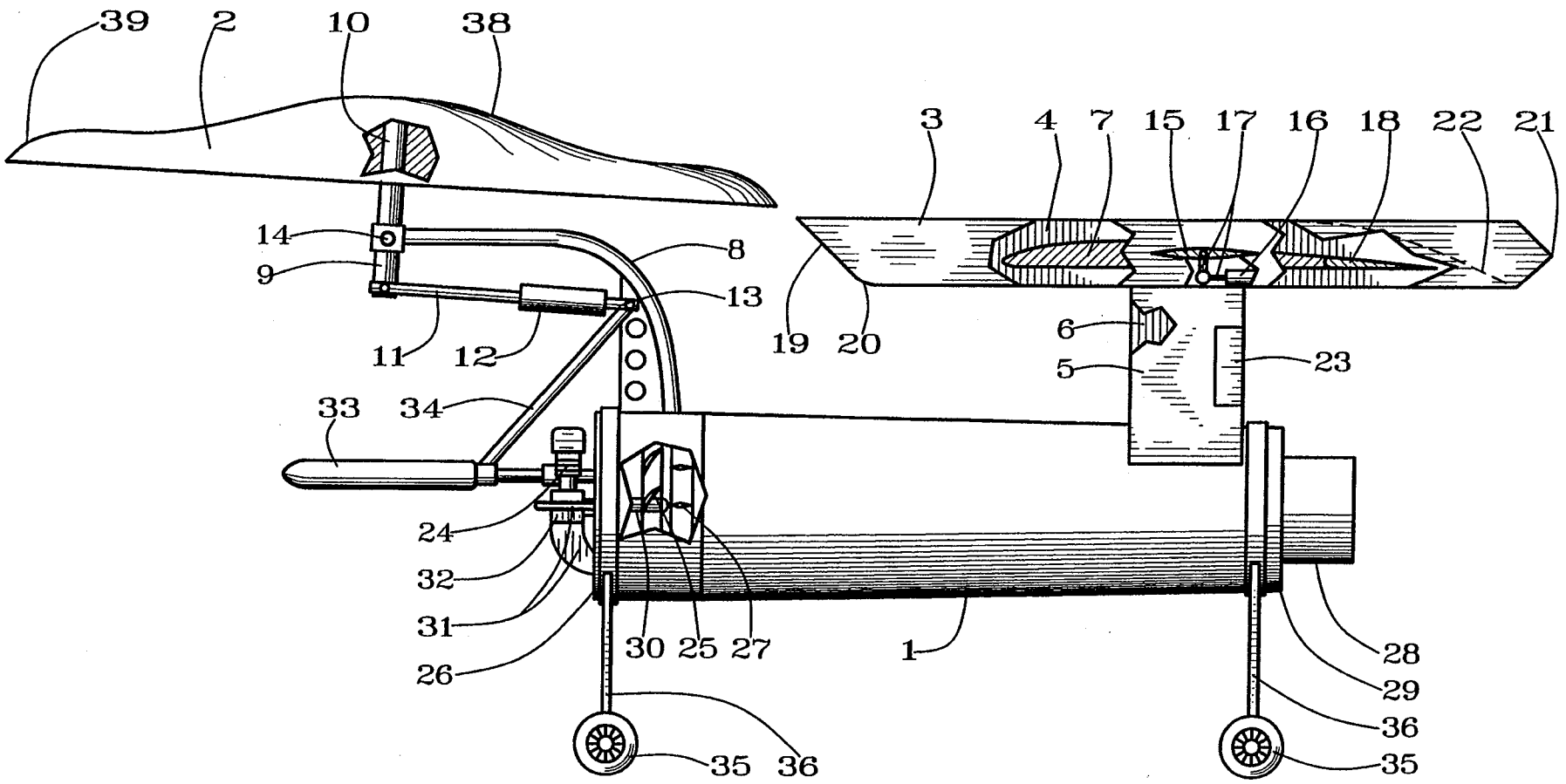
FIG. 1 is a cutaway side view of an embodiment having a pivotal round-edged wing.

Reference is made first to FIG. 1 of figures abbreviated for brevity on the drawings and referenced above as FIGS. 1–13. A propulsion duct 1 is provided with airfoil lift by a circular wing 2, a first pod wing 3, a second pod wing 4, a first side strut 5, a second side strut 6 and a stabilizer wing 7. The circular wing 2 is supported by a forward strut 8 to which the circular-edged wing 2 can be attached pivotally with a wing-pivot rod 9. Wing pivot rod 9 can have a wing axle 10 on which the circular wing 2 can rotate. The wing-pivot rod 9 can be pivoted by a wing-control rod 11 with a wing controller 12. The wing controller 12 can be a remote-controlled servo motor if remote control of attitude of the circular wing 2 is employed. If attitude of the circular-edged wing is desired to be fixed temporarily, an internally-threaded sleeve with oppositely-threaded ends can be screwed onto the wing-control rod 11 at one end and onto a pivotal strut end 13 of the wing-control rod 11. If attitude of the circular wing is desired to be fixed permanently, the wing controller 12 can be omitted. Pivotal attitude of the circular wing 2 is controlled by varying length of the wing-control rod 11 between pivotal attachment of the control rod 11 to the forward strut 8 and the wing pivot rod 9 by means of the wing controller 12. The wing-pivot rod 9 is attached pivotally to the forward strut 8 at wing-pivot axis 14.

Ailerons 15 on sides of pod wings 3 and 4 can be provided with aileron servo motors 16 and aileron-control linkage 17 for horizontal attitude control laterally. An elevator flap 18 can be employed to provide attitude control for climb and descent. For this embodiment, aerodynamic lift is provided with leading edges 19 of pod wings 3 and 4 that are sloped downwardly and rearwardly with an arcuate bottom edge 20. Rearward tilt of the circular wing 2 increases air-flow mass for bottom lift of the pod wings 3 and 4. A pod-wing trailing edge 21 can be contoured variously to eliminate lift as illustrated with equally-slanted top and bottom edges or to provide trailing-edge lift with a downwardly-sloped pod aft end 22 as illustrated with a broken line. Strut flaps 23 can be provided as an alternative or supplementary means for combined elevator and rudder functions as in conventional V-tail practice.

A rotational prime mover 24 rotates a ducted fan 25 inside of an intake end 26 of the propulsion duct 1. Flow straighteners 27 direct airflow axially through the propulsion duct 1 to a thrust tube 28 proximate an outlet end 29 of the propulsion duct 1. The ducted fan 25 can be mounted directly to a fan shaft 30 extended from the prime mover 24 or optionally to gear shaft, depending on the type of rotational prime mover 24 that is employed. The prime mover 24 can be mounted with engine struts 31 extended from the intake end 26 of the propulsion duct 1. Incorporated in an engine strut 31 can be a fuel line, not shown separately, to the prime mover 24. A throttle servo motor 32 can be provided for throttling fuel to the prime mover 24. For some types of prime movers 24, a tuned exhaust system 33 can be employed to direct exhaust from the prime mover 24 into the propulsion duct 1 to utilize all available mass flow and heat for propulsion. The tuned exhaust system 33 can be supported by an exhaust-system support rod 34 extended from the forward strut 8.

Wheels 35 can be suspended from the propulsion duct 1 with landing-gear struts 36. The landing-gear struts 36 can be resilient to withstand shock with minimal material weight.

Referring to FIG. 2, a battery 37 or other power source for operating servo motors and control means is positional in the pod wings 3 and 4 or in other suitable locations.

Referring to FIGS. 1–5, the circular wing 2 can be provided with a wing dome 38 that is relatively low in proportion to overall size of the circular wing 2. In FIGS. 1 and 2, an upwardly-slanted outside edge 39 of the circular wing 2 directs airflow in a vacuum-forming laminar pattern to an aft edge of the dome 38 to provide a double-vacuum lift adjacent to the edge 39 and adjacent to the dome 38. In FIG. 4, a relatively-high proportion of airflow is directed downwardly for bottom lift by a downwardly-slanted outside edge 40 of the circular wing 2. In FIG. 5, a proportionally-slanted leading edge 41 directs approximately three-fourths of the airflow upwardly and the remaining one-fourth downwardly in proportions approximating leading-edge contours of typical aircraft wings. With these alternative structures of the circular wing 2, lift can be achieved in accordance with desired design objectives. With either of these wing structures also, the circular wing 2 can be either freely-rotatable on wing axle 10 or fixed, depending on design objectives.

Referring further to FIG. 3, the thrust tube 28 can be pivotal laterally on thrust-tube pivot means 42. Lateral pivot of the thrust tube 28 provides steering without a rudder or vertical stabilizer. Additional steering can be provided optionally by a rudder or by V-wing flaps such as optional strut flaps 23 on struts 5 and 6.

Referring to FIGS. 6 and 7, delta-wing extensions of various proportions and forms 43 can be provided to form a delta-wing 44. The delta wing 44 is a fixed form of the circular wing 2. Contour of the delta wing 44 can be similar to standard laminar-flow wing design and one or more wing flaps 45 can be provided at a wing trailing edge 46. Due to forward positioning of the delta wing 44, the wing flaps 45 can provide both elevation and lateral control. A wing leading edge 47 of the delta wing 44 is contoured preferably with a proportionally-slanted leading edge 41 as described in relation to FIG. 5.

Figure 8:
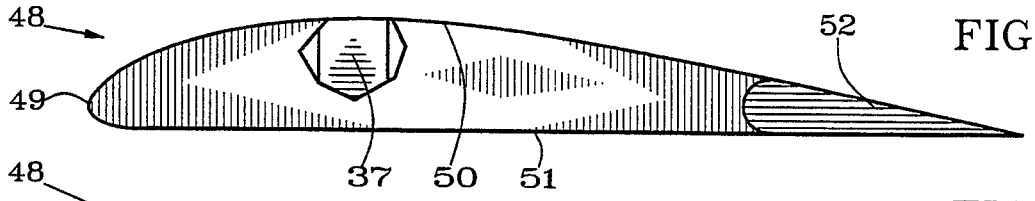
FIG. 8 is a side view of a pod wing with a high-lift structure and having an aft-edge aileron and central battery and/or fuel storage.
Figure 9:
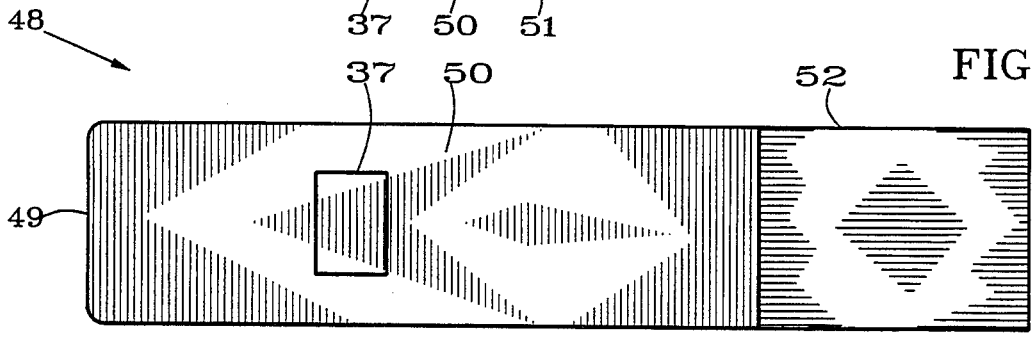
FIG. 9 is a top view of the FIG. 8 illustration.

Referring to FIGS. 8 and 9, a laminar-lift pod wing 48 can be provided with a proportionally-slanted leading edge 49, a laminar-flow top surface 50, a flat bottom surface 51 and an aileron flap 52 at an aft end. This contour can be employed to maximize airfoil lift of the wing pod 48. A battery 37 or other power pack can be positioned within a section approximating maximum thickness.

Figure 10:
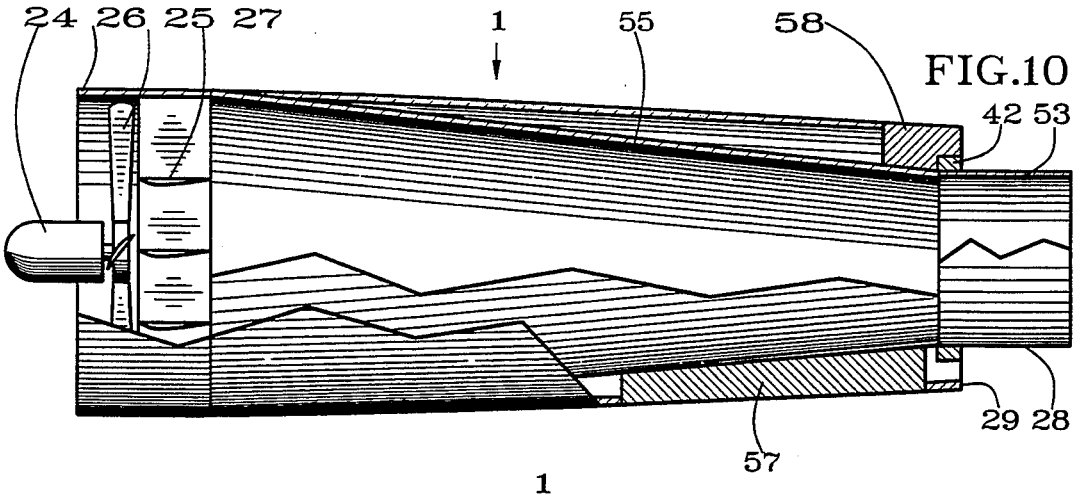
FIG. 10 is a partial cutaway cross-sectional side view of a propulsion duct having a rotational prime mover in rotational relationship to a fan, a flow straightener and pivotal thrust tube with straight walls.
Figure 11:
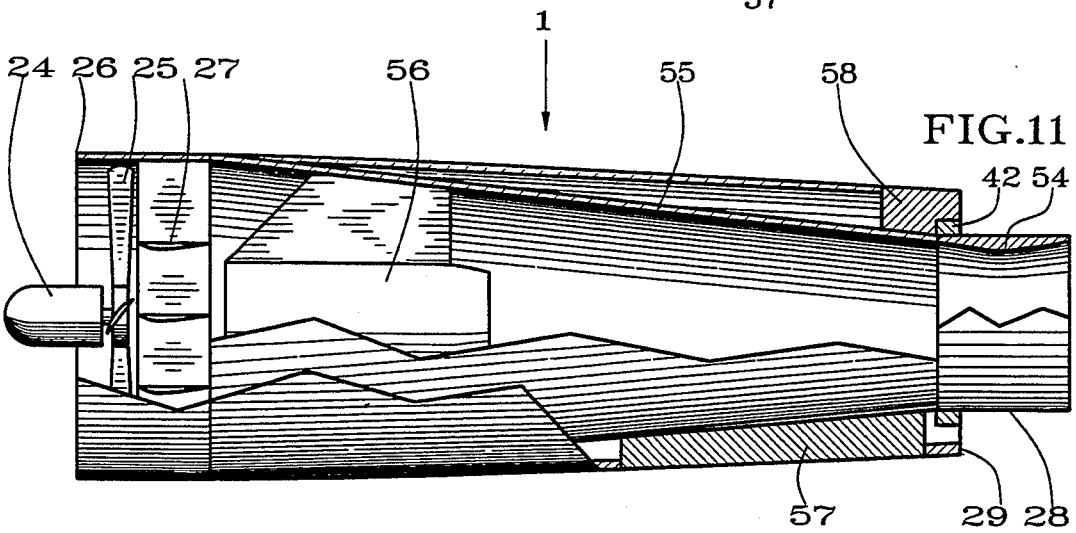
FIG. 11 is a partial cutaway cross-sectional side view of the FIG. 10 illustration with the addition of a reaction engine and with a thrust tube having a venturi throat.

Referring to FIGS. 10 and 11, a propulsion duct 1 can be provided with a thrust tube 28 having straight thrust-tube walls 53 as in FIG. 10 or venturi thrust-tube walls 54 as in FIG. 11. Venturi thrust-tube walls 54 allow greater increase in velocity of mass flow aft of an optionally inward-tapered section 55 of the propulsion tube 1. Venturi thrust-tube walls 54 are particularly advantageous when a reaction-propulsion prime mover 56 is employed in the propulsion tube 1. The reaction-propulsion prime mover 56 can be employed independently of, in addition to or as part of a rotational prime mover 24. The reaction-propulsion prime mover 56 can be either air-breathing, liquid-rocket, solid-rocket or a convertible engine. A fuel-storage area 57 can be provided in walls of the propulsion duct 1. Pivotal power for the thrust tube 28 can be provided by motor means such as a thrust-tube servo motor 58 positioned proximate the thrust-tube pivot means 42.

Figures 12, 13:
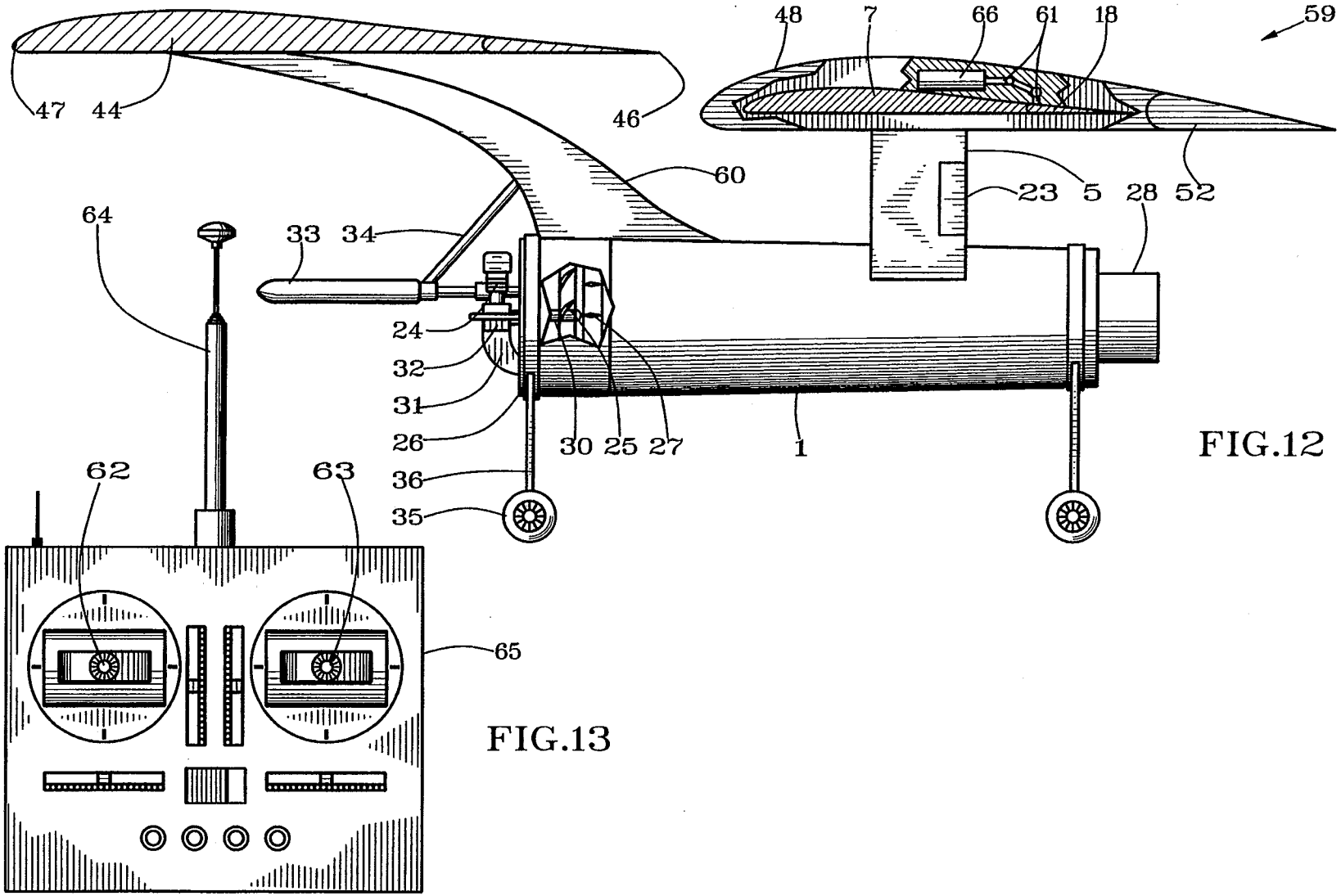
FIG. 12 is a partial cutaway cross-sectional side view of an embodiment having a circular-edged delta wing and a pod wing with top airfoil lift.
FIG. 13 is a front view of a standard digital proportional radio control system that is used as a remote controller.

Referring to FIG. 12, a delta-wing embodiment 59 can have a vertically-stabilizing forward strut 66 to which a fixed delta wing 44 is attached. The delta wing 44 can have a wide variety of forms and proportions. An elevator flap 18 on a stabilizer wing 7 can be actuated by a power means such as a stabilizer servo motor 60 having linkage 61 in communication with the elevator flap 18.

Referring to FIGS. 1–13, a model-airplane four-channel digital proportional radio control system can be employed as a controller 65. Lateral-control flaps such as ailerons 15 and aileron flaps 52 can be operated with lateral movement of the right control stick 63. Elevation-control flaps such as elevator flaps 18 can be operated with vertical movement of the right control stick 63. Throttle can be controlled through throttle servo motor 32 with vertical movement of left control stick 62. The thrust tube 28 can be pivoted for a steering effect with lateral movement of right control stick 63. When strut flaps 23 are employed, they are operated with the same control movement as for the thrust tube 28. Thus, the strut flaps 23 and the thrust tube can be employed simultaneously. When the circular-edged wing 2 is made pivotal on wing pivot axis 14 or when wing flaps 45 are employed, either can be made to operate in opposite motion to elevator flaps 18 for control of elevating attitude, such that up to seven servo systems can be operated with four radio-wave channels. The wing flaps 45 can be employed alternatively as ailerons in place of or in conjunction with aileron flaps 52.

Control sticks 62 and 63 can be wired to control different servo motors and control elements as may be desired for particular use-conditions by particular individuals. Either control arrangement can be employed for operation of a model or for a full-sized unit. Thus, a wide selection of controls and control combinations are available.

Radio waves are transmitted through antenna 64 to respective servo motors 12, 16, 32, 58 and 60. Additional and alternative servo motors can be provided for the variety of control features made possible.

A new and useful model spaceship having been described, all such modifications, adaptations, substitutions of equivalents, combinations of components, applications and forms thereof as described by the following claims are included in this invention.

I claim:

1. A spaceship comprising:

a propulsion duct having a tubular form with an inside periphery, an outside periphery, an intake end and a discharge end;

a ducted fan having a fan shaft concentric to a linear axis of the propulsion duct and positioned inside of the intake end of the propulsion duct;

a rotational prime mover attached to the propulsion duct and having rotational-drive relationship to the fan shaft;

a circular wing attached to a forward strut extended upward vertically and forwardly from a front portion of the outside periphery of the propulsion duct;

a first pod wing attached to a first side strut extended sidewards and upwards at a select angle from a first side of an intermediate portion of the outside periphery of the propulsion duct;

a second pod wing attached to a second side strut extended sidewards and upwards at a select angle from a second side of an intermediate portion of the outside periphery of the propulsion duct;

a stabilizer wing extended horizontally between the first pod wing and the second pod wing;

an aileron attached pivotally to each pod wing;

an elevator attached pivotally to a rear edge of the stabilizer wing; and a rudder means on an aft portion of the propulsion duct.

2. A spaceship as described in claim 1 and further comprising:

a remote controller in remote radio-wave-control communication with the aileron attached pivotally to each pod wing, the elevator attached pivotally to a rear edge of the stabilizer wing and the rudder means on an aft portion of the propulsion duct.

3. A spaceship as described in claim 1 and further comprising:

a remote controller in remote radio-wave-control communication with the aileron attached pivotally to each pod wing, the elevator attached pivotally to a rear edge of the stabilizer wing, the rudder means on an aft portion of the propulsion duct, and the rotational prime mover.

4. A spaceship as described in claim 1 and further comprising:

a remote controller in remote radio-wave-control communication with the aileron attached pivotally to each pod wing, the elevator attached pivotally to a rear edge of the stabilizer wing, the rudder means on an aft portion of the propulsion duct, the rotational prime mover, and the circular wing on the forward strut.

5. A spaceship as described in claim 1 wherein lift of the circular wing is provided by a low-dome contour on a central top surface of the circular wing such that laminar flow of air over a leading edge of the circular wing and lift vacuum over an aft portion of the circular wing are induced from forward movement of the circular wing propelled by the ducted fan when the ducted fan is rotated by the rotational prime mover.

6. A spaceship as described in claim 5 and further comprising:

an upward-slanted leading edge of the circular-edged wing to direct airflow in an upward curve from the leading edge and downward at an aft side of the low-dome contour to provide laminar-flow lifting vacuum over the circular-edged wing from forward travel in an atmosphere.

7. A spaceship as described in claim 5 and further comprising:

a downward-slanted leading edge of the circular-edged wing to direct airflow downward for frontal-edge lifting when a bottom surface of the circular-edged wing is in a horizontal attitude and traveling forward in an atmosphere.

8. A spaceship as described in claim 5 and further comprising:

an arcuate leading edge of the circular-edged wing having a top arcuate surface relatively larger than a bottom arcuate surface to direct airflow in an upward curve from the leading edge and downward at an aft side of the low-dome contour to provide laminar-flow lifting vacuum over the circular-edged wing and to direct airflow downward for frontal-edge lifting.

9. A spaceship as described in claim 1 wherein lift of the circular-edged wing is provided by a low-dome contour on a central top surface of the circular-edged wing such that laminar flow of air over a leading edge of the circular-edged wing and lift vacuum over an aft portion of the circular-edged wing are induced from forward movement of the circular-edged wing propelled by the ducted fan when the ducted fan is rotated by the rotational prime mover and further comprising:

rotatable attachment of a center of the circular-edged wing to the forward strut.

10. A spaceship as described in claim 1 and further comprising:

a downward and rearward slant on a leading edge of each pod wing to provide leading-edge lift.

11. A spaceship as described in claim 1 and further comprising:

an arcuate leading edge of each pod wing with a top arcuate surface relatively larger than a bottom arcuate surface to direct airflow in a design proportion upward and downward the leading edge of each wing pod;

a top surface of each wing pod having a laminar contour with an apex positioned at a design distance forward of a linear center; and a bottom surface of each wing pod being flat and extended from a terminus of the bottom arcuate surface to a trailing-edge terminus of the top surface of each pod wing in an attitude parallel to an axis of the propulsion duct.

12. A spaceship as described in claim 1 and further comprising:

an arcuate leading edge of each side strut with a top arcuate surface relatively larger than a bottom arcuate surface to direct airflow in a design proportion upward and downward the leading edge of each side strut;

a top surface of each side strut having a laminar contour with an apex positioned at a design distance forward of a linear center; and a bottom surface of each side strut being flat and extended from a terminus of the bottom arcuate surface to a trailing-edge terminus of the top surface of each side strut in an attitude parallel to an axis of the propulsion duct.

13. A spaceship as described in claim 12 wherein the select angle at which each side strut is extended sidewards and upwards from each side of the propulsion duct is configured as desired to provide lift with the side struts, to provide vertical stabilization and to provide desired length and lift capacity of the stabilizer wing extended horizontally between the two pod wings.

14. A spaceship as described in claim 1 wherein the inside periphery of the propulsion duct is coned from a major diameter at the intake end to a minor diameter at the discharge end to provide desired pressure build-up for a venturi effect to increase velocity of air at the discharge end of the propulsion duct.

15. A spaceship as described in claim 14 wherein the rudder means is a thrust tube having an inside periphery in laterally-pivotal relationship to the inside periphery of the discharge end of the propulsion duct such that air discharged from the discharge end of the propulsion duct can be directed in either side direction to steer the spaceship without a rudder or vertical stabilizer.

16. A spaceship as described in claim 15 wherein the thrust tube is coned outward selectively from a venturi throat at a position of pivotal communication with the minor diameter of the propulsion duct.

17. A spaceship as described in claim 1 wherein the rudder means is a thrust tube having an inside periphery in laterally-pivotal relationship to the inside periphery of the discharge end of the propulsion duct such that air discharged from the discharge end of the propulsion duct can be directed in either side direction to steer the spaceship without a rudder or vertical stabilizer.

18. A spaceship as described in claim 1 wherein the rudder means is a comprised of at least one rudder blade positioned pivotally on an aft edge of each side strut.

19. A spaceship comprising:

a propulsion duct having a tubular form with an inside periphery, an outside periphery, an intake end and a discharge end;

a ducted fan having a fan shaft concentric to a linear axis of the propulsion duct and positioned inside of the intake end of the propulsion duct;

a rotational prime mover attached to the propulsion duct and having rotational-drive relationship to the fan shaft;

a circular wing having a low-dome contour on a central top surface of the circular wing such that laminar flow of air over a leading edge of the circular wing and lift vacuum over an aft portion of the circular wing are induced from forward movement of the circular wing propelled by the ducted fan when the ducted fan is rotated by the rotational prime mover;

rotatable attachment of a center of the circular wing to a pivotal wing axle on the forward strut;

a first pod wing having aerodynamic-lift surfaces and attached to a first side strut extended sidewards and upwards at a select angle from a first side of an intermediate portion of the outside periphery of the propulsion duct;

a second pod wing having aerodynamic-lift surfaces and attached to a second side strut extended sidewards and upwards at a select angle from a second side of an intermediate portion of the outside periphery of the propulsion duct;

a stabilizer wing extended horizontally between the first pod wing and the second pod wing;

an aileron attached pivotally to each pod wing;

an elevator attached pivotally to a rear edge of the stabilizer wing;

a thrust tube having an inside periphery in laterally-pivotal relationship to the inside periphery of the discharge end of the propulsion duct such that air discharged from the discharge end of the propulsion duct can be directed in either side direction to steer the spaceship without a rudder or vertical stabilizer; and a remote controller in remote radio-wave-control communication with the aileron attached pivotally to each pod wing, the elevator attached pivotally to a rear edge of the stabilizer wing and the thrust tube.

20. A spaceship as described in claim 19 and further comprising:

a remote controller in remote radio-wave-control communication with the aileron attached pivotally to each pod wing, the elevator attached pivotally to a rear edge of the stabilizer wing, the thrust tube, the pivotal wing axle, and the rotational prime mover.

21. A spaceship as described in claim 1 and further comprising:

landing gear extending from the propulsion duct.

22. A spaceship comprising:

a propulsion duct having a tubular form with an inside periphery, an outside periphery, an intake end and a discharge end;

a ducted fan having a fan shaft concentric to a linear axis of the propulsion duct and positioned inside of the intake end of the propulsion duct;

a rotational prime mover attached to the propulsion duct and having rotational-drive relationship to the fan shaft;

a circular wing attached to a forward strut extended upward vertically and forwardly from a front portion of the outside periphery of the propulsion duct;

a delta wing section extended laterally from each side of the circular-edged wing;

an aerodynamic-lift surface on top of the circular-edged wing integrated with an aerodynamic-lift surface on top of each delta wing section such that the circular-edged wing and the delta wing sections form a single wing having a circular leading edge with delta-shaped side portions;

a first pod wing attached to a first side strut extended sidewards and upwards at a select angle from a first side of an intermediate portion of the outside periphery of the propulsion duct;

a second pod wing attached to a second side strut extended sidewards and upwards at a select angle from a second side of an intermediate portion of the outside periphery of the propulsion duct;

a stabilizer wing extended horizontally between the first pod wing and the second pod wing;

an aileron attached pivotally to each pod wing;

an elevator attached pivotally to a rear edge of the stabilizer wing; and a thrust tube having an inside periphery in laterally-pivotal relationship to the inside periphery of the discharge end of the propulsion duct such that air discharged from the discharge end of the propulsion duct can be directed in either side direction to steer the model spaceship without a rudder or vertical stabilizer.

23. A spaceship as described in claim 22 and further comprising:

a remote controller in remote radio-wave-control communication with the aileron attached pivotally to each pod wing, the elevator attached pivotally to a rear edge of the stabilizer wing, the thrust tube, and the rotational prime mover.

24. A spaceship as described in claim 22 and further comprising:

an arcuate leading edge of each pod wing with a top arcuate surface relatively larger than a bottom arcuate surface to direct airflow in a design proportion upward and downward the leading edge of each wing pod;

a top surface of each wing pod having a laminar contour with an apex positioned at a design distance forward of a linear center; and a bottom surface of each wing pod being flat and extended from a terminus of the bottom arcuate surface to a trailing-edge terminus of the top surface of each pod wing in an attitude parallel to an axis of the propulsion duct.

25. A spaceship as described in claim 24 wherein the aileron is attached pivotally to the trailing edge of each pod wing.

26. A spaceship as described in claim 25 and further comprising:

an arcuate leading edge of each side strut with a top arcuate surface relatively larger than a bottom arcuate surface to direct airflow in a design proportion upward and downward the leading edge of each side strut;

a top surface of each side strut having a laminar contour with an apex positioned at a design distance forward of a linear center;

a bottom surface of each side strut being flat and extended from a terminus of the bottom arcuate surface to a trailing-edge terminus of the top surface of each side strut in an attitude parallel to an axis of the propulsion duct; and the select angle at which each side strut is extended sidewards and upwards from each side of the propulsion duct is selected as desired to provide lift with the side ducts, to provide vertical stabilization and to provide desired length and lift capacity of the stabilizer wing extended horizontally between the two pod wings.

27. A spaceship as described in claim 22 wherein the inside periphery of the propulsion duct is coned at a selectively low degree from a major diameter at the intake end to a minor diameter at the discharge end to provide pressure buildup for a venturi effect to increase velocity of air at the discharge end of the propulsion duct; and wherein the thrust tube is coned outward selectively from a venturi throat proximate a position of pivotal communication with the minor diameter of the propulsion duct.

28. A spaceship as described in claim 22 and further comprising: landing gear extending from the propulsion duct.

* * * * *